US011097324B2

(12) United States Patent
Nguyen et al.

(10) Patent No.: US 11,097,324 B2
(45) Date of Patent: Aug. 24, 2021

(54) METAL STRIP COIL AND METHOD FOR MANUFACTURING THE SAME

(71) Applicant: HITACHI METALS, LTD., Tokyo (JP)

(72) Inventors: Thanh-Nghia Nguyen, Yasugi (JP); Takuya Okamoto, Yasugi (JP); Shinichiro Fukada, Yasugi (JP)

(73) Assignee: HITACHI METALS, LTD., Tokyo (JP)

( * ) Notice: Subject to any disclaimer, the term of this patent is extended or adjusted under 35 U.S.C. 154(b) by 293 days.

(21) Appl. No.: 16/337,813

(22) PCT Filed: Sep. 28, 2017

(86) PCT No.: PCT/JP2017/035185
§ 371 (c)(1),
(2) Date: Mar. 28, 2019

(87) PCT Pub. No.: WO2018/062375
PCT Pub. Date: Apr. 5, 2018

(65) Prior Publication Data

US 2019/0224734 A1 Jul. 25, 2019

(30) Foreign Application Priority Data

Sep. 29, 2016 (JP) ..... JP2016-190742

(51) Int. Cl.
*B21C 47/02* (2006.01)
*B65H 54/28* (2006.01)
(Continued)

(52) U.S. Cl.
CPC ..... *B21C 47/02* (2013.01); *B65H 54/02* (2013.01); *B65H 54/28* (2013.01); *C22C 38/00* (2013.01);
(Continued)

(58) Field of Classification Search
None
See application file for complete search history.

(56) References Cited

U.S. PATENT DOCUMENTS 2,605,053 A * 7/1952 Broden ..... B65H 54/2866 242/478
2,746,696 A * 5/1956 Tierney ..... C09J 7/00 242/159
(Continued)

FOREIGN PATENT DOCUMENTS

JP 3-133878 A 6/1991
JP 6-312878 A 11/1994
(Continued)

OTHER PUBLICATIONS

International Search Report and Written Opinion of the International Searching Authority with English language translation, International Application No. PCT/JP2017/035185, dated Nov. 14, 2017, 12 pp.
(Continued)

*Primary Examiner* — William A. Rivera
(74) *Attorney, Agent, or Firm* — Myers Bigel, P.A.

(57) ABSTRACT

The present invention provides a metal strip coil that can suppress a shape failure at an end portion of the coil. A metal strip coil including a metal strip wound around a winding core, wherein the metal strip is wound from one end side toward the other end side of the winding core, turns back at the other end portion, is wound from the other end side toward the one end side of the winding core, turns back at the one end portion, and is repeatedly wound in such a manner, wherein in the turnback, the metal strip has a turnback portion at which the metal strip is wound in a direction perpendicular to the axial direction of the winding core, in a side view of the metal strip coil, the turnback portion is arcuate, and the turnback portions are formed in
(Continued)

a multistage manner from the inner circumference toward the outer circumference, and a line connecting a midpoint of the arcuate arc with the center of the arc is formed so as to rotate stepwise in one direction, in an order of the arcuate turnback portions which are formed in a multistage manner from the inner circumference to the outer circumference.

9 Claims, 6 Drawing Sheets

(51) Int. Cl.

| | |
|---|---|
| ***C22C 38/02*** | (2006.01) |
| ***C22C 38/04*** | (2006.01) |
| ***C22C 38/18*** | (2006.01) |
| ***C22C 38/22*** | (2006.01) |
| ***B65H 54/02*** | (2006.01) |
| ***C22C 38/00*** | (2006.01) |

(52) U.S. Cl.
CPC ..... *C22C 38/02* (2013.01); *C22C 38/04* (2013.01); *C22C 38/18* (2013.01); *C22C 38/22* (2013.01)

(56) References Cited

U.S. PATENT DOCUMENTS

| | | | | | |
|---|---|---|---|---|---|
| 3,425,118 | A * | 2/1969 | Dobell | B21C 37/122 | 228/145 |
| 3,963,186 | A * | 6/1976 | Van den Aa | B65H 54/22 | 242/471 |
| 4,093,146 | A | 6/1978 | Haley | | |
| 4,413,792 | A * | 11/1983 | O'Connor | B65H 18/10 | 242/471 |
| 5,169,083 | A * | 12/1992 | Sannohe | B65H 55/04 | 242/178 |
| 5,921,487 | A * | 7/1999 | Junius | H01F 3/04 | 242/160.4 |
| 7,762,491 | B2 * | 7/2010 | Schmalholz | B65H 54/383 | 242/477.6 |
| 9,328,263 | B2 * | 5/2016 | Tach | C09J 7/20 | |
| 10,023,352 | B2 * | 7/2018 | Lipp | B65D 90/029 | |
| 2010/0139848 | A1 * | 6/2010 | Burke | F16L 9/042 | 156/191 |
| 2017/0312670 | A1 * | 11/2017 | Matsumoto | B21B 1/16 | |

FOREIGN PATENT DOCUMENTS

| | | | |
|---|---|---|---|
| JP | 9-300018 | A | 11/1997 |
| JP | 2008-100770 | A | 5/2008 |
| JP | 2009-18911 | A | 1/2009 |
| JP | 2009-166991 | A | 7/2009 |
| KR | 20120002081 | A | 1/2012 |
| WO | 95/13237 | A1 | 5/1995 |

OTHER PUBLICATIONS

"Examination report under sections 12 & 13 of the Patents Act, 1970 and the Patents Rules, 2003", Indian Patent Application No. 201917012095, dated Nov. 27, 2020, 6 pp.

* cited by examiner

METAL STRIP COIL AND METHOD FOR MANUFACTURING THE SAME

RELATED APPLICATIONS

This application is a 35 U.S.C. § 371 national stage application of PCT Application No. PCT/JP2017/035185, filed on Sep. 28, 2017, which claims priority from Japanese Patent Application No. 2016-190742, filed on Sep. 29, 2016, the contents of which are incorporated herein by reference in their entireties. The above-referenced PCT International Application was published in the Japanese language as International Publication No. WO 2018/062375 A1 on Apr. 5, 2018.

TECHNICAL FIELD

The present invention relates to a metal strip coil composed of a metal strip which is wound around a winding core, and to a method for manufacturing the same.

BACKGROUND ART

In general, a steel band which has undergone a cold rolling step becomes a metal strip through a strip slitting step which cuts the steel band to a desired width, becomes a metal strip coil which is wound around a reel, and is supplied to the next step. As for a shape of this metal strip coil, there have been conventionally used a pancake coil which is produced by being wound into a disk shape having the same width dimension as the metal strip; and an oscillation wound (hereinafter also referred to as spiral winding, spiral winding, traverse winding and cheese winding) coil which is produced by steps of forming one long metal strip by welding a plurality of metal strips having a predetermined dimension and then winding the long metal strip into a spool form.

The oscillation wound coil can wind a long metal strip into one coil as compared with the pancake coil, and accordingly, there is an advantage that productivity can be improved due to reduction in the number of exchanges of the coil in the next step. Concerning this oscillation wound coil, for example, a technology shown in the following is disclosed. In Patent Document 1, the method for winding a strip is described which adjusts a value of a fraction part of the number of revolutions of a bobbin per one reciprocation, in order to suppress a winding collapse of the metal strip and the damage to the strip.

REFERENCE DOCUMENT LIST

Patent Document

Patent Document 1: Japanese Patent Application Publication No. H03-133878

SUMMARY OF THE INVENTION

Problem to be Solved by the Invention

The oscillation wound coil described above is manufactured by steps of reciprocating a payoff portion or a reel of a metal strip in the direction of the center axis of the coil, and winding the metal strip while reversing the metal strip at an end portion of a preset coil width, but because of this reversal of the metal strip, both end portions of the metal strip coil tend to swell, which causes deterioration in the final shape of the metal strip coil. The invention of Patent Document 1 describes an effect of suppressing the winding collapse and damage of the metal strip, but does not refer to the suppression of shape deterioration due to the swelling of the end portions of the coil, and leaves room for study.

Then, an object of the present invention is to provide a metal strip coil which suppresses the swelling at both end portion portions and shows an adequate wound-up shape, and a method for manufacturing the same.

Means for Solving the Problem

Specifically, one aspect of the present invention is a metal strip coil including a metal strip wound around a winding core, wherein the metal strip is wound from one end side toward the other end side of the winding core at a winding angle which is tilted with respect to an axial direction of the winding core, turns back at the other end portion, is wound from the other end side toward the one end side of the winding core at a winding angle which is tilted with respect to the axial direction of the winding core, turns back at the one end portion, and is repeatedly wound in such a manner, wherein in the turnback, the metal strip has a turnback portion at which the metal strip is wound in a direction perpendicular to the axial direction of the winding core, turnback portions are formed in a multistage manner from an inner circumference toward an outer circumference, each turnback portion being arcuate in a side view of the metal strip coil, and a line connecting a midpoint of the arcuate arc with a center of the arc is formed so as to rotate stepwise in one direction, in an order of the arcuate turnback portions which are formed in the multistage manner from the inner circumference to the outer circumference.

Preferably, in a side view of the metal strip coil, an angle (°) between turnback portions is an angle other than angles represented by divisors of 360, the angle between turnback portions being defined by the angle formed by a line that connects the midpoint of the arcuate arc of the turnback portion with the center of the arc in an a-th stage (a is a natural number) and a line that connects the midpoint of the arcuate arc of the turnback portion with the center of the arc in an (a+1)-th stage.

Preferably, the angle between the turnback portions exceeds 15° and is less than 345°.

Preferably, in a side view of the metal strip coil, each of angles formed by the line that connects the midpoint of the arcuate arc of the turnback portion with the center of the arc in the a-th stage (a is a natural number) and lines that connect midpoints of the arcuate arcs of the turnback portions with the center of the arcs in (a+1)-th to (a+4)-th stages is greater than 6°.

Preferably, in a metal strip which is wound from one end side toward the other end side of the winding core, and from the other end side toward the one end side, the metal strip coil has an overlapping portion at which ends of adjacent turns of the metal strip overlap one another.

Preferably, a width of the overlapping portion of the metal strip is 10% or more of the width of the metal strip.

Another aspect of the present invention is a method for manufacturing a metal strip coil, including:

deriving an angle between turnback portions of the metal strip coil from the following Equations (1) and (2), and adjusting a space between turns of the metal strip, a width of the metal strip and a width of the metal strip coil so that the obtained angle between the turnback portions becomes an angle excluding 0° or 360°, $$(W_{oc}+d)/(W_s+d)=(E+F) \quad \text{Equation (1):}$$

$$\phi=\gamma+360°\times F \quad \text{Equation (2):}$$

where $W_{oc}$: width of metal strip coil, d: space between turns of metal strip, $W_s$: width of metal strip, E: integer part of solution of Equation (1), F: decimal fraction part of solution of Equation (1), $\phi$: angle between turnback portions, and $\gamma$: angle of side turnback portion)

Preferably, the space between the turns of the metal strip, the width of the metal strip, and the width of the metal strip coil are adjusted so that the angle (°) between the turnback portions becomes an angle other than angles represented by divisors of 360 to wind the metal strip.

Preferably, when the metal strip is wound around the winding core, a tension at completion of the winding is set at 20 to 90% of the tension at start of the winding.

Effects of the Invention

According to the present invention, the method can suppress the swelling at an end portion of a metal strip coil which is produced by an oscillation winding, and obtain a metal strip coil of which the wound-up shape is adequate.

MODE FOR CARRYING OUT THE INVENTION

Embodiments of the present invention will be described in detail below, but the present invention should not be construed to be limited to the following description. The composition of the metal strip that is an object of the present embodiment is not limited in particular, but the composition may be any one as long as the composition has, for example, a composition of high carbon stainless steel which is generally applied to a steel band for cutlery; and is, for example, an Fe-based alloy which essentially contains, by mass %, 0.3 to 1.5% C, 10 to 18% Cr, 1% or less (not including 0%) Si, 1.5% or less (not including 0%) Mn, and contains 3% or less (including 0%) Mo, as needed.

Figure 2:
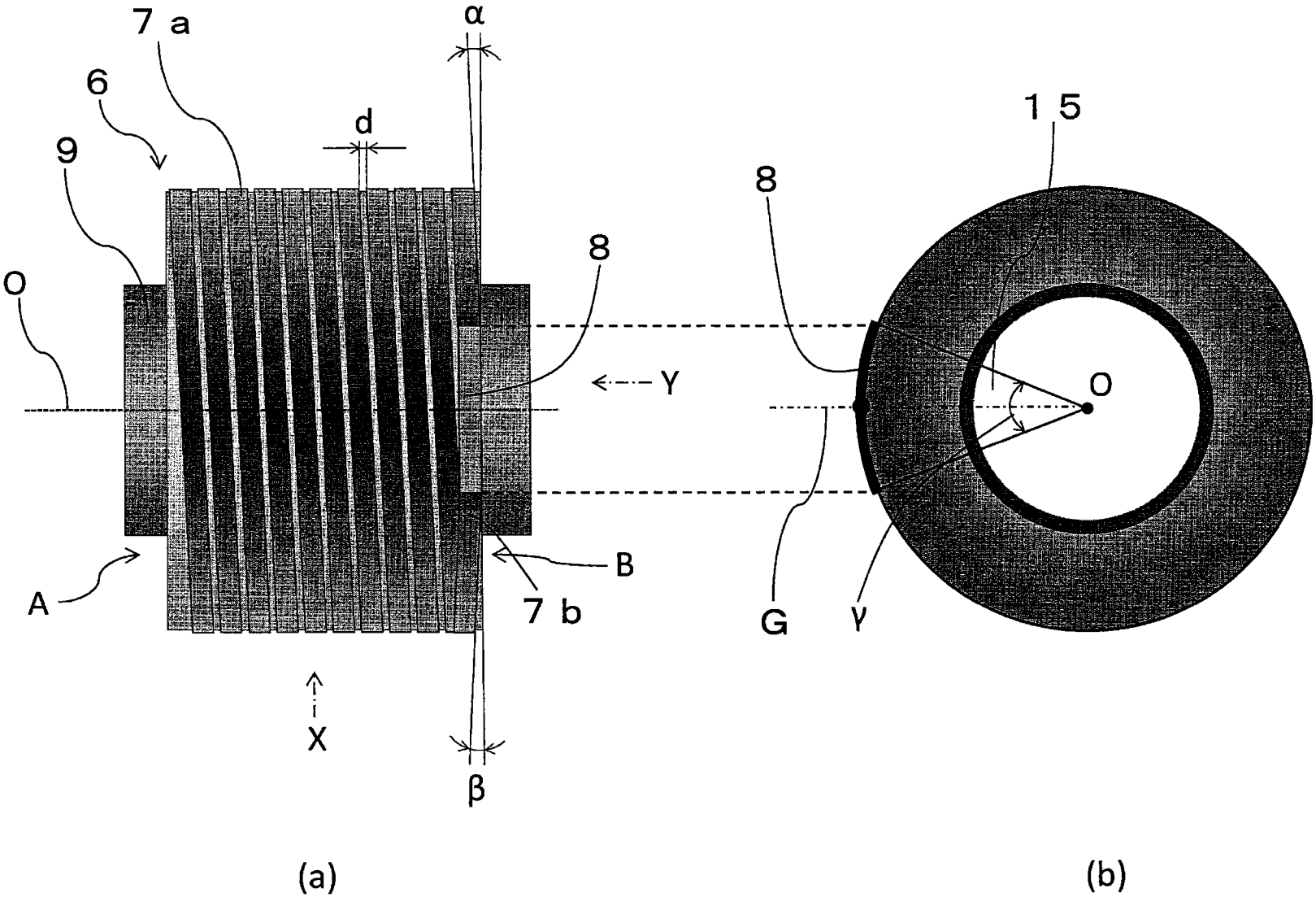
FIG. 2 is a schematic front view and a schematic side view for describing the metal strip coil of the present invention.

FIG. 2(*a*) is a schematic front view showing a wound state of the metal strip coil of the present embodiment; and FIG. 2(*b*) is a schematic side view showing the metal strip coil of the present invention, viewed from the direction of the Y arrow line of FIG. 2(*a*). The metal strip coil of the present embodiment shown in FIGS. 2(*a*) and 2(*b*) is produced by spirally winding (oscillation winding) metal strip 7*a*, 7*b* around the winding core 9, while forming a space d between turns of the metal strip. As shown in FIG. 2(*a*), the metal strip 7*a* which is wound from one end side A toward the other end side B of the winding core, at a winding angle $\alpha$ (winding angle tilted with respect to a direction perpendicular to axial direction of winding core), turns back when having reached the other end portion B. In this turnback, the metal strip forms a turnback portion 8 at which the metal strip is wound in a direction perpendicular to the axial direction of the winding core. Then, the metal strip is wound from the other end side B of the coil toward the one end side A, at a winding angle $\beta$ (winding angle tilted with respect to direction perpendicular to axial direction of winding core), and the metal strip coil according to the present embodiment is formed by repeating the operation. Note that, in the present embodiment, a paper tube is used for the winding core of the coil, but it is acceptable to use a reel having a side plate, and also as for the material, it is also possible to use a winding core made of rubber or metal.

Figure 3:
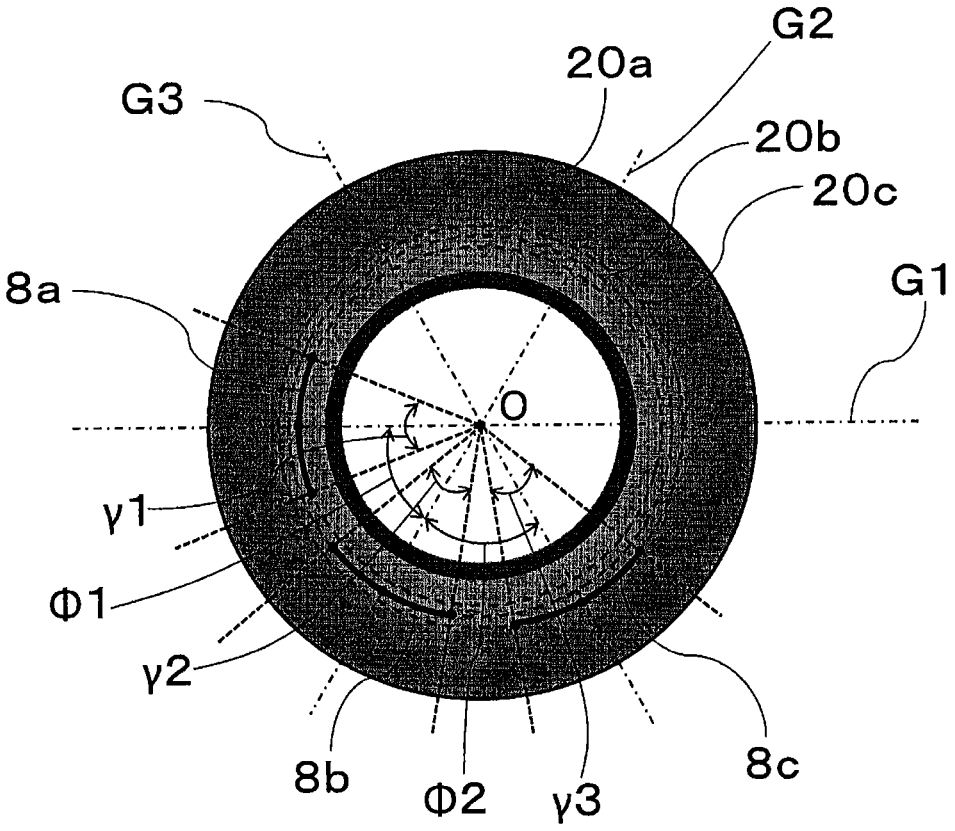
FIG. 3 is a side view for describing a turnback portion of the present invention.

As shown in FIG. 2(*a*) and FIG. 2(*b*), at the previously described turnback portion of the metal strip, a turnback portion 8 which is wound in the direction perpendicular to the axial direction of the winding core (portion at which winding angles $\alpha$ and $\beta$ become 0°) is formed at both end portions of the metal strip coil (though only turnback portions on the other end portion B side is shown in FIGS. 2(*a*) and 2(*b*)). In addition, a plurality of turnback portions formed in different layers are arranged from the inner circumference toward the outer circumference in a multistage manner. Here, as shown in FIG. 2(*b*), the turnback portion 8 becomes an arcuate shape, and this angle $\gamma$ is a central angle of an arcuate arc of the turnback portion 8 (hereinafter also referred to as angle of side turnback portion.). When the winding progresses and the outer diameter of the metal strip coil increases, if the above-described turnback portions 8 continue overlapping, the portion swells and becomes a factor of deteriorating the final coil shape. Then, an important feature of the present invention is that, as shown in FIG. 3, a line connecting the midpoint of the arcuate arc of the turnback portion with the center of the arc is formed so as to rotate in one direction stepwise, in an order such that arcuate turnback portions are formed from the inner circumference toward the outer circumference in a multistage manner. In this way, the central lines of the turnback portions do not overlap one another at the upper and lower turnback portions by sequentially deviating lines connecting the midpoints of the arcuate arcs of the turnback portions 8 with the center of the arc (hereinafter also simply referred to as "central line of turnback portion") so as not to overlap at the upper and lower turnback portions and so as to rotate in one direction. In other words, the metal strip coil of the present invention is characterized in that a line connecting the midpoint of the arcuate arc of the turnback portion at the (a+1)-th stage (a is a natural number) with the center of the arc is sequentially formed at positions in a winding direction side or an opposite direction side to the winding direction so as not to overlap with a line connecting the midpoint of the arcuate of the turnback portion at the a-th stage with the center of the arc, and is formed so as to rotate stepwise. As used herein, "sequentially" means that a direction in which the angle between the turnback portions and the angle of the turnback portion which will be described later continue deviating does not change on the way and is constant in all layers of the metal strip coil.

The features of the present invention will be specifically described with reference to FIG. 3. FIG. 3 is a schematic side view of a metal strip coil having the same field of view as that of FIG. 2(*b*). In FIG. 3, a turnback portion at a certain a-th stage (a is a freely chosen natural number) is shown by 8*a*, a turnback portion at an (a+1)-th stage is shown by 8*b*, and a turnback portion at an (a+2)-th stage is shown by 8*c*. The angles of side turnback portions of the turnback portions 8*a*, 8*b* and 8*c* are shown by γ1, γ2 and γ3, respectively. In the metal strip coil of the present embodiment, the turnback portion 8*b* is formed so as to deviate counterclockwise from the turnback portion 8*a* directly below the turnback portion 8*b*, and similarly, the turnback portion 8*c* is also formed so as to deviate counterclockwise from the turnback portion 8*b* directly below the turnback portion 8*c*. In addition, a central line G1 of the turnback portion at the a-th stage, a central line G2 of the 25, turnback portion at the (a+1)-th stage, and a central line G3 of the turnback portion at the (a+2)-th stage are formed so as not to overlap one another and so as to be spaced apart from each other (so as to rotate). By forming the turnback portion 8 in this way, it is possible to suppress the swelling of the end portion of the metal strip coil even when the winding progresses, and it is possible to obtain an adequate wound-up shape. Note that, in the present specification, the turnback portion at an end portion in the side view from the direction of the Y arrow line is described, but the turnback portion at an end portion in the other side view also has the same features as in the above description.

In FIG. 3, the fan-shaped regions which can be drawn by each of the turnback portions 8*a* to 8*c* and the central axis O are formed so that adjacent fan-shaped regions do not completely overlap one another, but the turnback portion can be overlapped as long as the central lines of the turnback portions do not overlap. As used herein, to overlap the turnback portions means to overlap the fan-shaped regions which can be drawn by the turnback portions and the central axis O, in the side view of FIG. 3. As for a length of a circular arc of this overlapping region, it is preferable that when it is assumed that the angle of the side turnback portion is fixed in the side view of the metal strip coil, the length of the circular arc of the turnback portion 8 on the inner circumferential side is less than 70% of the length of the circular arc of the turnback portion 8 on the outer circumferential side. The length on the inner circumferential side is more preferably 50% or less, and further preferably is 30% or less. In the present embodiment, it is preferable that the amount of change in the angle of the side turnback portion be within ±5%.

In the side view of the metal strip coil of the present embodiment, it is preferable that an angle between the turnback portions, which is defined by an angle formed by a line connecting the midpoint of the arcuate arc of the turnback portion at the a-th stage with the center of the arc and a line connecting the midpoint of the arcuate arc of the turnback portion at the (a+1)-th stage with the center of the arc, be an angle excluding multiples of 15°. According to FIG. 3, the angle ϕ1 formed by the central line G1 of the turnback portion at the a-th stage and the central line G2 of the turnback portion at the (a+1)-th stage is the angle between the turnback portions at the a-th stage and the (a+1)-th stage. Similarly, the angle ϕ2 formed by the central line G2 of the turnback portion at the (a+1)-th stage and the central line G3 of the turnback portion at the (a+2)-th stage is the angle between the turnback portions at the (a+1)-th stage and the (a+2)-th stage. This is because if the angle between the turnback portions is an angle represented by a divisor of 360, the position of the turnback portion becomes a factor causing the deterioration of the coil shape when the winding progresses. (For example, the position of the turnback portion is repeated for every two layers in the case of 180°, and for every six layers in the case of 60°.) By excluding the above-described angle, the overlap of the turnback portions is reduced even though the winding layer increases, and accordingly it is possible to suppress the swelling of the end portion of the metal strip coil and to obtain a metal strip coil having a more adequate wound shape. As for the angle between the turnback portions, it is more preferable to exclude also angles represented by numbers obtained by subtracting such divisors from 360. Here, it is preferable for the amount of the change of the angles between the turnback portions in every winding layer to be within ±3°, and is more preferable that it be within ±1°. Within the above-described range, the workability is satisfactory without finely adjusting the angle at the time of the manufacture of the metal strip coil, and it is possible to obtain the metal strip coil of the present invention.

As for the angle between the turnback portions of the present embodiment, it is more preferable to exclude the angles of 0° to 15° and 345° to 360°. By excluding the above-described ranges of angles, it is possible to form the fan-shaped regions sufficiently away from each other, which can be drawn by each of the turnback portions 8*a* to 8*c* and the central axis O, and such an effect is expected to further suppress the deterioration of the shape of the metal strip coil. In addition, in the present embodiment, when it is desired to more reliably suppress the swelling of the end portion of the coil, it is more preferable that in the side view of the metal strip coil, each of angles between the central line of the turnback portion at the a-th stage and the central lines of the turnback portions at the (a+1)-th to (a+4)-th stages be larger than 6°. Furthermore, it is preferable that each of the angles between the central line of the turnback portion at the a-th stage and central lines of turnback portions at the (a+1)-th to (a+7)-th stages be larger than 6°. Thereby, it becomes possible to suppress the overlap of the fan-shaped regions which can be drawn by the turnback portions in each winding layer and the central axis O, and to manufacture a metal strip coil having a further adequate wound shape.

It is preferable that the angle of the side turnback portion of the present embodiment be 10° to 180°. When the angle of the side turnback portion is less than 10°, it is considered that damage to the metal strip due to a sudden change of the winding angle and the worsening of the wound shape may easily occur. When the angle of the side turnback portion exceeds 180°, the deterioration of the wound shape due to the overlap of the turnback portions tends to increase. A more preferable lower limit of the angle of the side turnback portion is 20°. In addition, a more preferable upper limit of the angle of the side turnback portion is 120°, and a further preferable upper limit of the angle of the side turnback portion is 90°.

Figure 4:
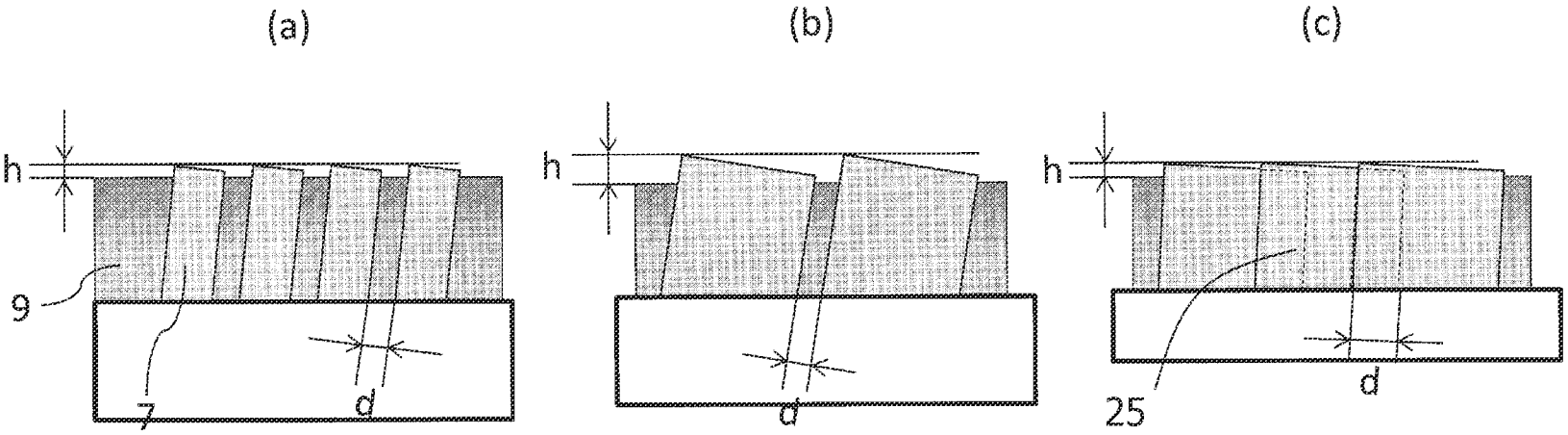
FIG. 4 is a schematic diagram for describing an overlapping portion of the present invention.

It is preferable that the metal strip coil according to the present embodiment have an overlapping portion at which end portions of adjacent part of the metal strip in the axial direction of the winding core overlap one another, in the metal strip wound around the winding core from one end side toward the other end side and from the other end side toward the one end side. This is particularly effective when a wide metal strip (for example, 10 mm or more) is oscillation wound. FIG. 4 is a schematic view of the turnback portion of the metal strip coil, viewed from the direction of the X arrow line in FIG. 2(*a*). As shown in FIG. 4(*a*) and FIG. 4(*b*), when the width of the metal strip becomes wider, the winding angle of the metal strip must be increased in order to make the space d between the part of the metal strip wide, and accordingly the lifting height h increases. This excessive lifting height is not desirable because it leads to damage of the metal strip and the worsening of the coil shape. By providing the overlapping portion 25 at which the end portions of the metal strip overlap one another as shown in FIG. 4(*c*), the winding angle of the metal strip is reduced, and thereby, the excessive lifting height is suppressed; and it becomes possible to obtain a coil having an adequate shape even in the case of the metal strip having a wide width. In order to reliably obtain the previously described effect, it is more preferable that the width of the overlapping portion be 10% or more of the width of the metal strip. In addition, if the overlapping portion is too large, many spaces are formed in the metal strip coil, which has a possibility of causing failures, and accordingly, it is more preferable that the overlapping width be 80% or less of the width of the metal strip.

As for a diameter of the winding core to be applied to the metal strip coil of the present embodiment, winding cores having various sizes may be applied according to the use to which it is to be applied. For example, when it is desired to wind a larger amount of metal strip, it is effective to set the diameter of the winding core to 300 mm or more in the present embodiment. Conventionally, there has been a tendency that when a wide metal strip is wound around a winding core having a winding core diameter of, for example, approximately 300 mm, a crease occurs in the metal strip due to a sudden change of the winding angle. In order to suppress this crease failure, it is effective to increase the diameter of the winding core, but the total amount of metal strip that can be wound is reduced, and it there is a concern that a problem will arise in that productivity decreases. The metal strip coil of the present embodiment can suppress the crease of the metal strip by adjusting the above-described overlapping width, and accordingly it is possible to stably wind even a metal strip having a wide width, around a winding core having a winding core diameter of, for example, 300 mm. A more preferable lower limit of the diameter of the winding core is 330 mm. Note that an upper limit of the diameter of the winding core is not specified in particular, but if the diameter is too large, the amount of the metal strip to be wound decreases, and accordingly the upper limit may be set at 600 mm, for example.

Figure 1:
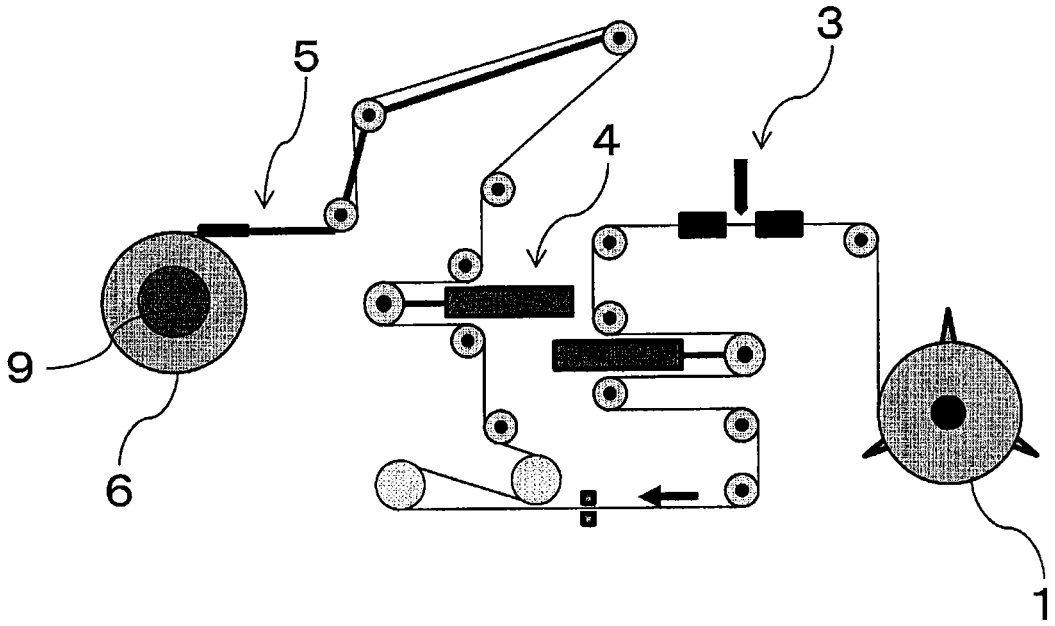
FIG. 1 is a schematic view showing one example of a facility configuration to be used for manufacturing a metal strip coil according to the present invention.

Subsequently, a method for manufacturing a metal strip coil according to the present invention will be described. FIG. 1 shows one example of an apparatus configuration to be used in the present embodiment. The metal strip which has been cut after the cold rolling step is wound in a pancake coil shape, and is set on an unwinder 1. Next, the metal strip is unwound from the unwinder, passes through an arm unit 5 after the tension is controlled by a dancer 4, is wound spirally around a winding core 9 or the like which is provided on a winding machine, and becomes a metal strip coil 6 of the present embodiment. When the metal strip is unwound from one pancake coil, a metal strip is unwound from a next pancake coil, and end portions in the length direction of the metal strips are welded to each other by a laser welding machine 3. Thereby, a long metal strip is formed. In the present embodiment, an oscillation wound coil is produced by reciprocating the arm unit, but it is also acceptable to produce an oscillation wound coil by fixing the arm unit and reciprocating the winding core 9.

The angle between the turnback portions of the metal strip coil of the present embodiment can be determined from the following Equations (1) and (2).

$$(W_{oc}+d)/(W_s+d)=(E+F) \quad \text{Equation (1):}$$

$$\phi=\gamma+360°\times F \quad \text{Equation (2):}$$

Here, $W_{oc}$ represents a width of a metal strip coil, d represents a space between turns of the metal strip, $W_s$ represents a width of the metal strip, E represents an integer part of the solution of Equation (1), F represents a decimal fraction part of the solution of Equation (1), $\phi$ represents an angle between turnback portions, and $\gamma$ represents an angle of a side turnback portion. By adjusting these parameters, it is possible to obtain an angle between the turnback portions which are suitable for the metal strip coil of the present embodiment. In a manufacturing method of the present embodiment, the space between the turns of the metal strip, the width of the metal strip and the width of the metal strip coil are adjusted so that the angle between the turnback portions, which is derived by use of the above-described calculation Equations, becomes an angle excluding 0° or 360°. By using the above-described Equations, it is possible to easily derive each parameter necessary for obtaining a desired angle between the turnback portions. Preferably, the space between the turns of the metal strip, the width of the metal strip and the width of the metal strip coil are adjusted so that the angle (°) between the turnback portions becomes an angle other than angles represented by the divisors of 360. The upper limit of the width $W_s$ of the metal strip is not limited in particular, but if the width is too wide, it is necessary to increase a diameter of the coil, in order to stably perform the winding so that the metal strip is not damaged. Then, the productivity and the efficiency tend to decrease, and accordingly, it is preferable to set the upper limit at 40 mm. The lower limit of the width $W_s$ of the metal strip is also not limited in particular, but the lower limit may be set at 10 mm, in order to surely exert the above-described effect of the overlapping portion at an end portion of the metal strip.

In order to adjust the angle of the side turnback portion, it is possible to adjust the angle by stopping a reciprocating motion of the arm unit for a certain period of time when the reciprocating arm unit reaches an end portion of a predetermined width of the metal strip coil. When it is desired to adjust the angle of the side turnback portion to 45° when the number of revolutions at the time of winding of the metal strip coil is set at 60 rpm, it is possible to adjust the angle of the side turnback portion to 45°, by stopping the reciprocating motion of the arm unit for 0.125 seconds, when the arm unit reaches the end portion of the width of the metal strip coil. Note that the overlapping width can be adjusted by the amount of parallel movement of the arm unit (amount of movement in direction parallel to axis of winding core) moving while the metal strip goes round the winding core. When it is desired to adjust, for example, the width of the metal strip to 20 mm and the overlapping width to 5 mm, it is acceptable to adjust the amount of the parallel movement of the arm unit moving while the metal strip goes around the winding core, to 15 mm.

It is preferable for the method for manufacturing the metal strip coil of the present embodiment to set a tension at the completion of the winding at 20 to 90% of a tension at the start of the winding, when the metal strip is wound around the winding core. In addition, when the metal strip is wound, it is preferable to gradually decrease the winding tension from the start of the winding to the completion of the winding. By controlling the winding tension as described above, it is possible to adjust an internal stress of the metal coil and suppress the occurrence of a shape failure such as telescoping, and accordingly, it is possible to stably wind a large amount of metal strip. A preferable upper limit of the tension at the completion of the winding is 70% of that at the start of the winding. A more preferable upper limit of the tension at the completion of the winding is 50% of that at the start of the winding. Here, "gradual decrease" means that the winding tension decreases linearly or curvilinearly without rising or sharply decreasing on the way, in a period between the start of the winding and the completion of the winding described above. Alternatively, it is possible to provide (stepwise) a section in which the winding tension does not decrease but is a constant tension, on a part. In order to control the winding tension of the embodiment, it is acceptable to control the tension by mechanisms of controlling a rotation speed, a friction resistance or the like of a reel which winds the metal strip, or to control the tension by incorporating an existing tension control device such as a tension pad and a bridle roll, in front of the winding reel.

EXAMPLES

The present invention will be described in more detail in the following Examples.

Example 1

Figure 5:
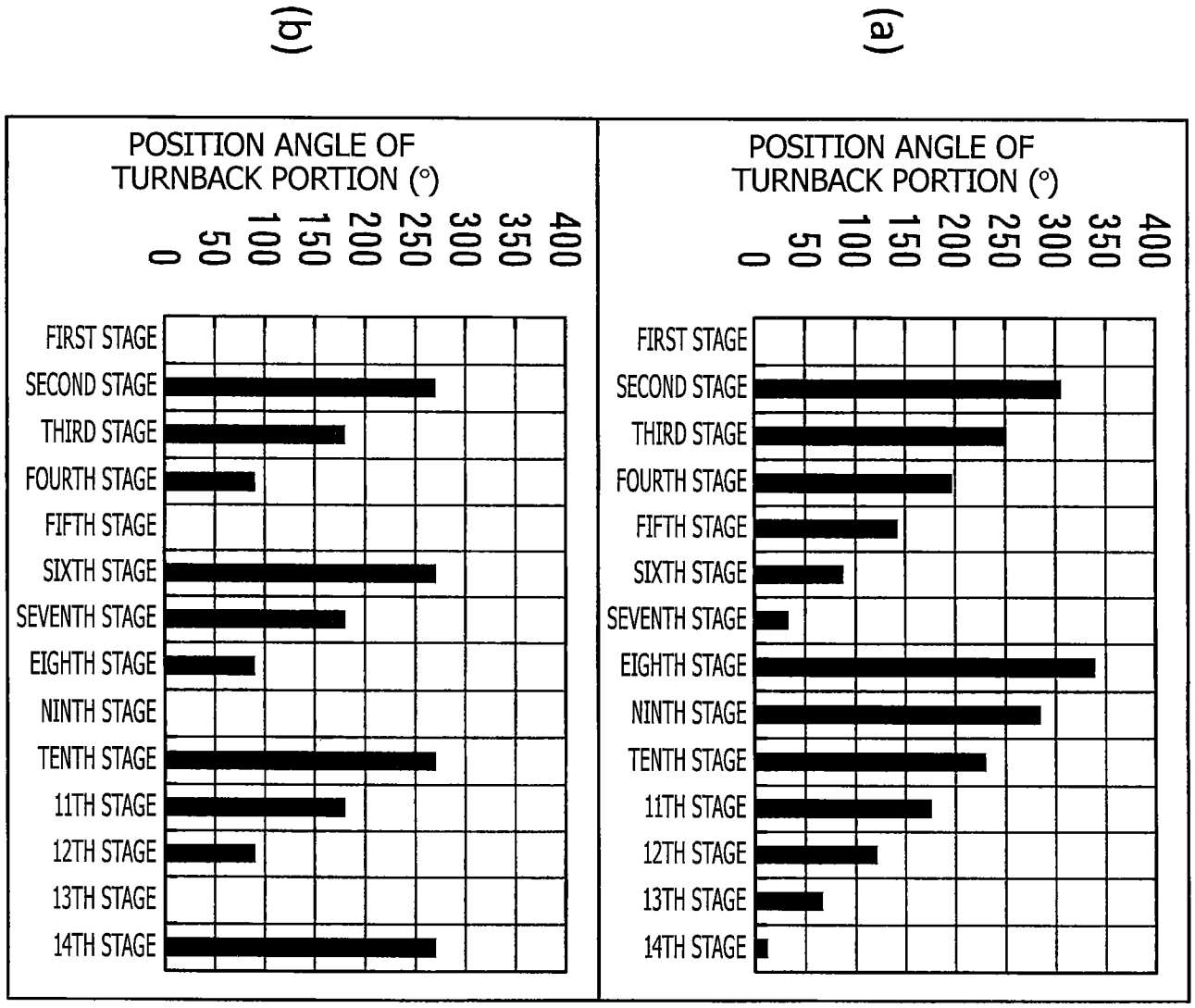
FIG. 5 is a measurement diagram of an absolute angle in a rotation direction of the winding core, which shows positions of the turnback portions of the metal strip coil in an example of the present invention.

A metal strip of a martensitic stainless steel having a composition shown in Table 1 and having a width of 22 mm and a thickness of 0.1 mm was prepared, and it was wound spirally around a paper tube having an outer diameter of 350 mm; and a metal strip coil having an outer diameter of 600 m and a coil width of 160 mm was produced. Note that, when the coil was produced, the tension at the completion of the winding was adjusted to be approximately 20% to 50% of the tension at the start of the winding. The angle of the side turnback portion was adjusted to 45°. As shown in Table 2, two types of metal strip coils of the present invention were produced, of which the spaces between turns of the metal strips were −9.4 mm (Example 1 of present invention) and −11.8 mm (Example 2 of present invention). The space between turns of the metal strip was adjusted so that the angle between the turnback portions did not become 0° or 360°, by use of Equation (1): $(W_{oc}+d)/(W_s+d)=(E+F)$, Equation (2): $\phi=\gamma+360°\times F$ ($W_{oc}$: width of metal strip coil, d: space between turns of metal strip, $W_s$: width of metal strip, E: integer part of solution of Equation (1), F: decimal fraction part of solution of Equation (1), $\phi$: angle between turnback portions, and $\gamma$: angle of side turnback portion). Note that "-" of the space between turns of the metal strip means that one end of the metal strip overlaps as shown in FIG. 4(*c*), and for example, −9.4 mm means that the overlapping width is 9.4 mm. The observation results are shown in Table 2 and FIG. 5. Note that an angle between the turnback portions in Table 2 indicates the angle in each winding layer, and is measured with reference to the rotating direction of the paper tube. FIG. 5 is a graph obtained by the measurement of the positions of the turnback portions from the first stage (first layer) to the fourteenth stage (14th layer) of the metal strip coil; and the "position angle of turnback portion" on the vertical axis is an angle that shows a position at which the turnback portion of the (a+1)-th stage (a is a freely chosen natural number) exists, with reference to the position of the turnback portion of the first stage, and is an angle (absolute angle in rotation direction of paper tube) formed by a central line of the turnback portion at the first stage when the coil is viewed from the side, and a straight line passing through the (a+1)-th stage (a is a freely chosen natural number). FIG. 5(*a*) shows an observation result of No. 1, and FIG. 5(*b*) shows an observation result of No. 2. These results mean that the turnback portions move in one direction sequentially from the first stage. Note that it was confirmed by a preliminary experiment that in a metal strip coil in which an angle between the turnback portions was adjusted to 360° by adjusting a space between turns of the metal strip (turnback portions overlap over whole winding layers), large swelling occurred at an end portion of the coil.

TABLE 1

(mass %)

| C | Si | Mn | Cr | Balance |
|---|---|---|---|---|
| 0.68 | 0.29 | 0.73 | 13.26 | Fe and unavoidable impurities |

TABLE 2

| No. | Space between turns of metal strip (mm) | Angle between turnback portions | Coil shape |
|---|---|---|---|
| 1 | −9.4 | 306° | Good |
| 2 | −11.8 | 270° | Occurrence of small shape failure |

It was confirmed from Table 2 that in the metal strip coil of No. 1, which was an example of the present invention, the difference in height between the central portion and both end portions in the coil width direction was approximately 0 mm, and there was no swelling, and that the wound-up shape was extremely satisfactory. The metal strip coil of Example 2 of the present invention showed such a shape that both end portions of the coil were swelled to be slightly larger than the central portion in the width direction, but it was confirmed that the swelling was smaller than that of the metal strip coil in which the turnback portions overlapped over the whole winding layers. This is because as shown in FIG. 5, in the metal strip coil of No. 1, any one layer among 14 layers does not overlap at the same positions, but in the coil of No. 2, the position angles of the side turnback portions overlap once every 4 layers.

Example 2

Next, an effect of the overlapping width was confirmed. The metal strip of the martensitic stainless steel having the composition shown in Table 1 and having the width of 22 mm and the thickness of 0.1 mm was wound spirally around a paper tube having an outer diameter of 350 mm whereas a space between turns of the metal strip was set at +1 mm, and the metal strip coil (No. 3) was produced; and the wound-up shape was observed. The other manufacturing conditions of the metal strip coil are the same as those of No. 1 of Example 1. Note that "+1 mm" of the space between turns of the metal strip means that adjacent turns of the metal strip do not overlap and have a space of 1 mm therebetween. As a result of confirmation, in the coil of No. 3, a crease occurred due to the increase of the winding angle, and a result was obtained such that the wound shape was slightly inferior to that of the metal strip coil of No. 1. On the other hand, it was confirmed that in the metal strip coil of No. 4, which was produced around a paper tube having an outer diameter of 550 mm under the same manufacturing conditions as those of the metal strip coil of No. 3, the winding amount was less than those of No. 1 and also the productivity was inferior to those of No. 1, but the swelling at the end portion of the coil could be suppressed.

Example 3

Subsequently, an influence on the overlapping region of the turnback portion was checked. A metal strip coil of No.

Figure 6:
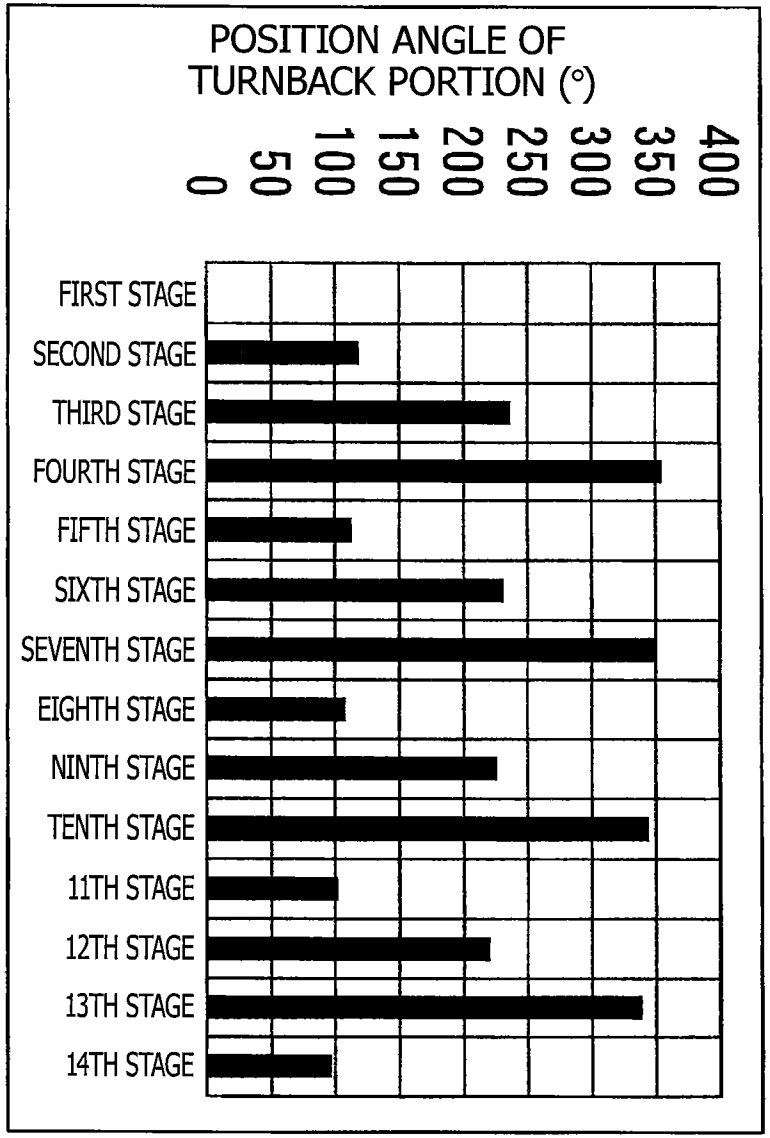
FIG. 6 is a measurement diagram of an absolute angle in a rotation direction of the winding core, which shows positions of the turnback portions of the metal strip coil in another example of the present invention.

4 was produced in which the angles between the turnback portions in each winding layer were adjusted to 118° by changing the width of the metal strip coil, on the basis of the manufacturing conditions of No. 1 of Example 1. Other manufacturing conditions of the metal strip coil are similar to those of No. 1 of Example 1. FIG. 6 shows a graph obtained by the measurement of the positions of the turnback portions from the first stage to the fourteenth stage of the metal strip coil of No. 4. As shown in the figure, the position angles of the turnback portions of No. 4 are formed so as not to overlap on each winding layer, but the difference between angles at the a-th stage and the a+3-th stage (for example, second stage and fifth stage, third stage and sixth stage, and fourth stage and seventh stage) was approximately 5°. Thereby, the metal strip coil of No. 3 caused such a level of deviation between steps on the side of the coil as not to be a problem in practical use, and showed a wound shape which was somewhat inferior to that of the metal strip coil of No. 1; but it was confirmed that the swelling at the end portion of the coil could be suppressed.

REFERENCE SYMBOL LIST

1: 7*a* and 7*b*. Metal strip
2: Pancake coil
3: Welding machine
4: Dancer
5: Arm unit
6: Metal strip coil
8, 8*a*, 8*b* and 8*c*: Turnback portion
9. Winding core
20*a*, 20*b* and 20*c*: Winding layer
25: Overlapping portion
d: Space between turns of metal strip
g1, g2 and g3: Central portion of turnback portion
h: Lifting height
O: Central axis of metal strip coil
α and β: Winding angle
γ, γ1, γ2 and γ3: Angle of side turnback portion
ϕ, ϕ1, ϕ2 and ϕ3: Angle between turnback portions

The invention claimed is:

1. A metal strip coil comprising a metal strip wound around a winding core, wherein the metal strip is wound from one end side toward the other end side of the winding core at a winding angle which is tilted with respect to an axial direction of the winding core, turns back at the other end portion, is wound from the other end side toward the one end side of the winding core at a winding angle which is tilted with respect to the axial direction of the winding core, turns back at the one end portion, and is repeatedly wound in such a manner, wherein in the turnback, the metal strip has a turnback portion at which the metal strip is wound in a direction perpendicular to the axial direction of the winding core, wherein turnback portions are formed in a multistage manner from an inner circumference toward an outer circumference, each turnback portion being arcuate in a side view of the metal strip coil, and a line connecting a midpoint of the arcuate arc with a center of the arc is formed so as to rotate stepwise in one direction, in an order of the arcuate turnback portions which are formed in the multistage manner from the inner circumference to the outer circumference.

2. The metal strip coil according to claim 1, wherein in a side view of the metal strip coil, an angle(°) between turnback portions is an angle other than angles represented by divisors of 360, the angle between turnback portions being defined by an angle formed by a line that connects the midpoint of the arcuate arc of the turnback portion with the center of the arc in an a-th stage (a is a natural number) and a line that connects the midpoint of the arcuate arc of the turnback portion with the center of the arc in an (a+1)-th stage.

3. The metal strip coil according to claim 2, wherein the angle between the turnback portions exceeds 15° and is less than 345°.

4. The metal strip coil according to claim 1, wherein in a side view of the metal strip coil, each of the angles formed by the line that connects the midpoint of the arcuate arc of the turnback portion with the center of the arc in the a-th stage (a is a natural number) and lines that connect midpoints of the arcuate arcs of the turnback portions with the center of the arcs in (a+1)-th to (a+4)-th stages is greater than 6°.

5. The metal strip coil according to claim 1, wherein in a metal strip which is wound from one end side toward the other end side of the winding core, and from the other end side toward the one end side, the metal strip coil has an overlapping portion at which ends of adjacent turns of the metal strip overlap one another.

6. The metal strip coil according to claim 5, wherein a width of the overlapping portion of the metal strip is 10% or more of the width of the metal strip.

7. A method for manufacturing the metal strip coil according to claim 1, the method comprising:

deriving an angle between turnback portions of the metal strip coil from the following Equations (1) and (2); and adjusting a space between turns of the metal strip, a width of the metal strip and a width of the metal strip coil so that the obtained angle between the turnback portions becomes an angle excluding 0° or 360° to wind the metal strip, $$(W_{oc}+d)/(W_s+d)=(E+F) \quad \text{Equation (1)}$$

$$(\phi)=\gamma+360°\times F \quad \text{Equation (2)}$$

where $W_{oc}$: width of metal strip coil, d: space between turns of metal strip, $W_s$: width of metal strip, E: integer part of solution of Equation (1), F: decimal fraction part of solution of Equation (1), ϕ: angle between turnback portions, and γ: angle of side turnback portion.

8. The method of manufacturing the metal strip coil according to claim 7, wherein the space between the turns of the metal strip, the width of the metal strip, and the width of the metal strip coil are adjusted so that the angle(°) between the turnback portions becomes an angle other than angles represented by divisors of 360 to wind the metal strip.

9. The method of manufacturing the metal strip coil according to claim 7, wherein when the metal strip is wound around the winding core, a tension at completion of the winding is set at 20 to 90% of the tension at start of the winding.

* * * * *